US006354883B2

(12) United States Patent
Jaing

(10) Patent No.: US 6,354,883 B2
(45) **Date of Patent: *Mar. 12, 2002**

(54) CONNECTOR WITH ADJUSTABLE THICKNESS

(75) Inventor: Li-shaing Jaing, Hsinchu (TW)

(73) Assignee: Accton Technology Corporation (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/507,567

(22) Filed: Feb. 18, 2000

(51) Int. Cl.[7] ..... H01R 24/00
(52) U.S. Cl. ..... 439/676
(58) Field of Search ..... 439/676, 131, 439/946

(56) References Cited

U.S. PATENT DOCUMENTS 5,773,332 A * 6/1998 Glad ..... 439/344
6,113,432 A * 9/2000 Liao ..... 439/638
6,115,256 A * 9/2000 Centofante ..... 361/737

* cited by examiner

*Primary Examiner*—Brian Sircus
*Assistant Examiner*—Brian S. Webb

(57) ABSTRACT

A connector for connecting a circuit board with at least one signal line, each signal line comprises a plug with a plurality of electric contacts. The connector includes a base, a cover, a plurality of base electric contacts, and at least one adjustable means. The cover is provided above the base, the plurality of base electric contacts is provided on the base, and the adjustable means is connected to the base and the cover, whereby the cover is able to move from a preparation position that the distance between the cover and the base is smaller, to an operation position that the distance between the cover and the base is larger. When the cover is at the preparation position, the plug is inserted and held between the base and the cover, and each of the plurality of electric contacts of the plug is in electric contact with the corresponding base electric contact to transmit signals between the signal line and the circuit board.

17 Claims, 2 Drawing Sheets

CONNECTOR WITH ADJUSTABLE THICKNESS

BACKGROUND OF THE INVENTION

1. Field of the Invention

The present invention relates to a connector. More particularly, it relates to a connector with adjustable thickness for connecting at least one signal line with a circuit board.

2. Description of the Related Art

Generally, electronic devices or computer systems use signal lines to connect each other. Because the different standards between various transmission devices, it is required to design different connectors to satisfy the connection requirements between different transmission devices.

For example, most telephone lines use RJ series plugs to connect to a transmission device. The RJ-11plug, which is widely used on telephones and fax machines, has a thickness about 11.2 mm, and has a bias clip for connection with a connector. However, the PCMCIA (Personal Computer Memory Card International Association) card being used on a common notebook has a thickness below 8 mm, and the thickness of a thinner PCMCIA card is merely 3.5 mm. Because their thicknesses are different, it is required to design an additional connector to connect the RJ series plug with the PCMCIA card.

U.S. Pat. No. 5,183,404 to Aldous disclosed a method to connect the RJ series plug to the PCMCIA card. The basic concept of Aldous is to add a connector on the PCMCIA card so that the RJ series plug can plug into the PCMCIA card along a direction perpendicular to the principal surface of the PCMCIA card. However, the disadvantage of Aldous is that the electric contact exposes to the surrounding environment. Thus, a user may contact with the electric contacts and get an electric shock, and the contacts may be inadvertently shorted together. Furthermore, the structure disclosed in Aldous reference is particularly prone to breakage, and the plug will easily be loosened due to the inherently weak structure.

U.S. Pat. No. 5,773,332 to Glad disclosed another connection method, which plug the RJ series plug into an end of the PCMCIA card along a direction parallel to the principal surface of the PCMCIA card. Although this connection method improved the disadvantages in the Aldous reference, however, it did not solve the problem that the thickness of the RJ series plug is larger than that of the PCMCIA card. So, when building the PCMCIA card into an electronic device that has a smaller size, like a notebook, its large thickness will become a disadvantage. For example, as for the thickness of a common notebook, two PCMCIA slot can be provided in parallel on the sidewall of the notebook. However, when implementing the design according to the Glad reference, if the PCMCIA card is built in or inserted into the notebook, because the thickness of the RJ series plug is larger then that of the PCMCIA card, only one slot can be provided on the side wall of the notebook. This results in the waste of space in the notebook.

U.S. Pat. No. 6,000,957 to Betker disclosed another connector, which is in a shape of a platform with a hold-down pivotally mounted on the platform. When the connector is in a extended position, the hold-down is perpendicular to the platform to hold the RJ series plug on the platform, and when the connector is in a stored position, the hold-down is parallel to the platform so that it is easy to push the platform and the hold-down together into the housing of the PCMCIA card. The advantage of this design is that the thickness of the connector is thinner, so when the PCMCIA card is built in an electronic device that has a smaller size, the space will not wasted as the Glad reference. However, the connection between the platform and the hold-down is too weak, which is particularly prone to breakage and damage, and the plug will loose easily.

SUMMARY OF THE INVENTION

In view of the above disadvantages, it is an object of the invention to provide an connector which mechanical strength is stronger, so that it is not prone to breakage, and the plug it holds will not loose easily.

It is another object of the invention to provide a connector for a circuit board which occupies fewer space.

To achieve the above objects, the connector of the invention includes a base, a cover and at least one adjustable means. The cover is provided above the base, and the adjustable means is connected to the base and the cover. By adjusting the adjustable means, the cover is able to move from a preparation position that the distance between the cover and the base is smaller, to an operation position that the distance between the cover and the base is larger.

According to the connector of the invention, the strength of its structure is stronger, so it will not be damaged easily when bearing external forces, and the plug held in the connector will not loose easily.

According to the connector of the invention, when the cover is at the preparation position, the total thickness of the connector is thinner, so the required space is smaller.

DETAILED DESCRIPTION OF THE PREFERRED EMBODIMENT

Figure 1:
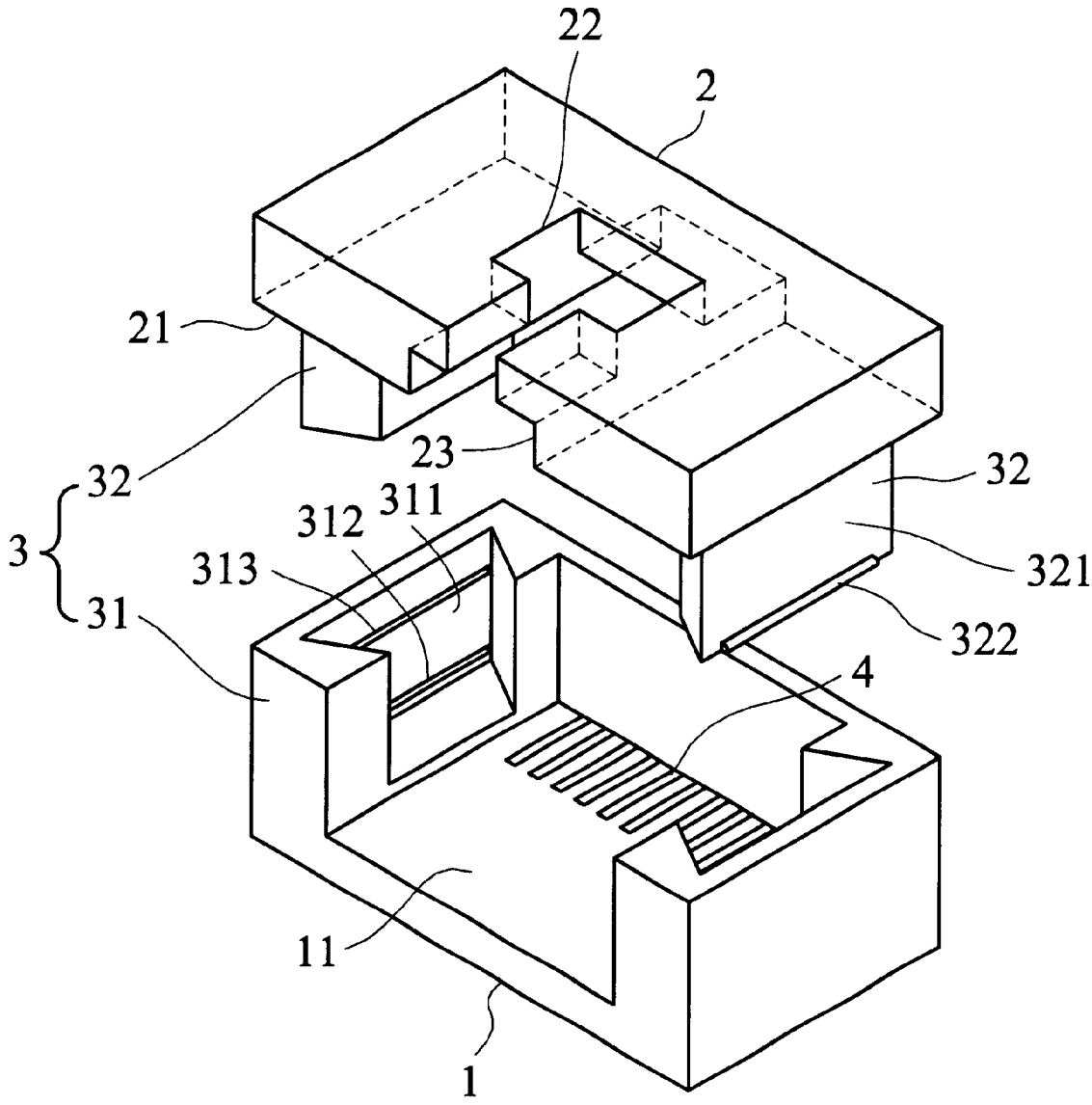
FIG. 1 is a perspective view showing the connector according the preferred embodiment of the invention.

The connector of the invention is now described in detail reference to the preferred embodiment diagrammed in the drawings.

Referring to FIG. 1 the connector according the preferred embodiment of the invention includes a base 1, a cover 2 and two adjustable means 3. The connector according the preferred embodiment is to connect a RJ-11 plug having a bias clip and a PCMCIA card. Of course, the connector of the invention is not limited to the type or the number of the plug, or the type of the card.

Base 1 includes an upper surface 11, and the cover 2 includes a lower surface 21. The upper surface 11 and the lower surface 21 face and are parallel with each other, and the plug is held between them. A plurality of base electric contacts 4 are provided on the upper surface 11 of the base 1. The cover 2 has a clip retention recess 22 and a clip passing recess 23. The clip retention recess 22 is generally T-shaped, and is fit with the bias clip of a RJ-11 plug. The clip passing recess 23 is formed on the lower surface of the cover 2, so that when a RJ-11 plug is inserted into the connector, the bias clip can pass into and fit in the clip retention recess 22.

The adjustable means 3 may be any device that can change the distance between the base 1 and the cover 2. In the present embodiment, two rigid parts, a lower adjustable part 31 and an upper adjustable part 32 construct each adjustable means 3. The lower adjustable part 31 that is in the shape of a groove is connected to the side of the base 1, and extends perpendicular to the upper surface 11 upwardly. The upper adjustable part 32 which is in the shape of a slider that fits with the lower adjustable part 31 is connected to the side of the cover 2, and extends perpendicular to the lower surface 21 downwardly. Therefore, the lower adjustable part 31 and the upper adjustable part 32 constitute a conjugated configuration, due to which the base 1, the cover 2 and the adjustable means 3 form an integrated structure.

The lower adjustable part 31 has a lower adjustable part side surface 311 inside the channel, and the upper adjustable part 31 has an upper adjustable part side surface 321 when the lower adjustable part 31 is assembled with the upper adjustable part 32, the lower adjustable part side surface 311 and the upper adjustable part side surface 321 face are parallel with each other. A preparation position groove 312 and an operation position groove 313 are formed on the lower adjustable part side surface 311. The extension directions of the preparation position groove 312 and the operation position groove 313 are both parallel to the upper surface 11, and the operation position groove 313 is father to the upper surface 11 than the preparation position groove 312. A projection portion 322 is formed on the upper adjustable part side surface 311. The projection portion 322 is shaped to fit the preparation position groove 312 and the operation position groove 313 that the projection portion 322 and both the preparation position groove 312 and the operation position groove 313 have a large contact surface in comparison with a convex point and its corresponding groove. Therefore, the projection portion 322 can engage with the preparation position groove 312 or the operation position groove 313 after the preparation position groove 312, the operation position groove 313 and the projection portion 322 are used many times.

In FIG. 1, the adjustable means on the right side and left side of the connection apparatus are formed symmetrically with each other. However, the two adjustable means do not have to be formed symmetrically. For example, the preparation position groove and the operation position groove may only be formed on the lower adjustable part side surface on the lower adjustable part on the left side, and the projection potion may only be formed on the on the upper adjustable part side surface on the upper adjustable part on the left side. The upper adjustable part and the lower adjustable part on the right side may be in a simple slider-channel relationship. Such design does not effect the function of the adjustable means.

Figure 2:
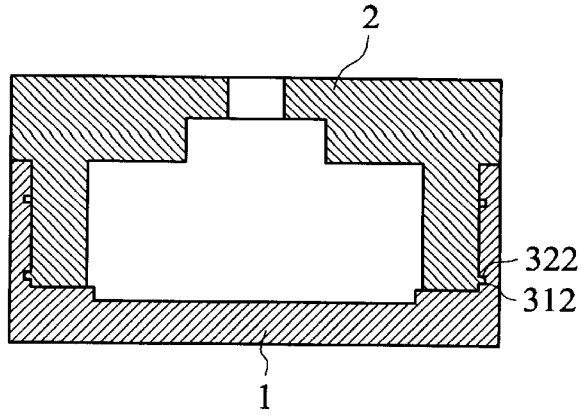
FIG. 2 is a cross-sectional view showing the connector according the preferred embodiment of the invention, wherein the cover is at the preparation position.

FIG. 2 is a sectional view, showing the connector according the preferred embodiment of the invention that is in a preparation status. When the projection portion 322 is engaged with the preparation position groove 312, the cover 2 is closer to the base 1, so the overall thickness of the connector is thinner.

Figure 3:
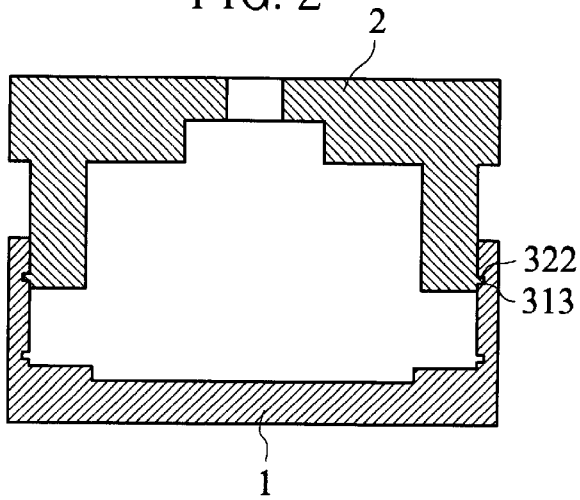
FIG. 3 is a cross-sectional view showing the connector according the preferred embodiment of the invention, wherein the cover is at the operation position.

Referring to FIG. 3, when the projection portion 322 is engaged with the operation position groove 313, the cover 2 is farther from the base 1. So, the overall thickness of the connector is thicker, and the space between the lower surface 21 and the upper surface 11 is enough to hold a RJ-11 plug.

Figure 4:
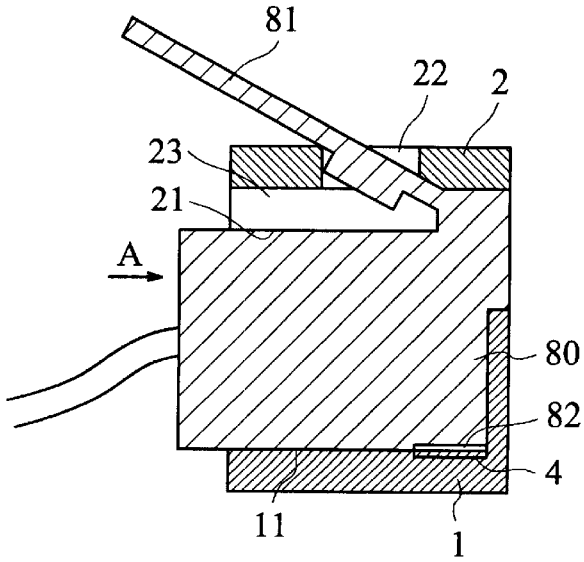
FIG. 4 is a cross-sectional view showing the connector according the preferred embodiment of the invention which is connected with a RJ-11 plug.

Referring to FIG. 4, when a RJ-11 plug 80 is to be inserted into the connector between the base 1 and the cover 2, the direction which the RJ-11 plug travels is substantially parallel to the lower surface 21 and the upper surface 11, that is, the direction of the arrow A in FIG.4. When the RJ-11 plug is inserted, the bias clip 81 is firstly pressed toward the RJ-11 plug. After passing through the clip passing recess 23, the bias clip 81 returns to its original position, and engages into the clip retention recess 22. When the removal of the RJ-11 plug 80 is desired, the bias clip 81 is compressed manually so that it can pass through the clip passing recess 23. Then, the RJ-11 plug 80 can be removed. By the operations mentioned above, the RJ-11 plug 80 can be hold in the connector according to the invention and be withdrew manually, and the base electric contact 4 on the base 1 can be electrically contacted with the corresponding electric contact 82 on the RJ-11 plug 80.

According to the invention, the connector has a preparation mode in which the thickness of the connector is thinner and an operation mode in which the thickness of the connector is thicker. So, when the plug is not inserted, the connection apparatus can be in the preparation mode and occupies less space. Besides, when the signal line connected to the plug is pulled by an external force, the direction that the connection apparatus resists the force is parallel to the upper surface and the lower surface. According to the invention, each part of the connection apparatus, including the adjustable means, may be formed by rigid material. So, the mechanical strength of each part of the connection apparatus according to the invention is stronger along the direction that the connection apparatus resists the external force. Therefore, the connection apparatus can hold the plug firmly. The connection apparatus will not be damaged easily by external forces, and the plug held in the connection apparatus will not loose easily. Thus, the connection apparatus according to the invention has the advantage of both the adjustable thickness and the stronger mechanical strength.

In addition to the embodiment described above, the invention may be embodied in different ways without departing from its spirit or essential characteristics. For example, by varying the dimension of the connector, a plurality of plugs can be held between the base and the cover at the same time. The shape of the upper adjustable part and the lower adjustable part can also be modified without departing from the function of changing the distance between the base and the cover. Furthermore, the connector according to the invention is not limited to the type or the number of the plug, or the type of the card it connected. So, the connector may be utilized more extensively by modifying its dimension or the standard of its electric contact.

So, the above embodiment is considered in all aspects only as illustrative and not restrictive. All changes and modifications that come within the range of equivalency of the claims are to be embraced within their scope.

Which is claimed is:

1. A connector for connecting a circuit board with at least one signal line having a plug, said connector comprising:

a base having an upper surface;

a cover provided above said base, said cover having a lower surface facing said upper surface and being substantially parallel to said upper surface; and at least one adjustable means connected to said base and said cover, said adjustable means comprising a rigid upper adjustable part connected to said cover and a rigid lower adjustable part connected to said base, said lower adjustable part side surface having a preparation position groove and an operation position groove while said operation position groove being closer to said cover than said preparation position groove, said upper adjustable part side surface having a projection portion projecting perpendicularly from said upper adjustable part side surface and being engaged with one of said preparation position groove and said operation position groove, wherein said cover is able to move from a preparation position that the distance between said cover and said base is small to an operation position that said distance between said cover and said base is large, and said adjustable means includes a conjugated configuration while said preparation position groove, said operation groove and said projection portion have a large contact surface, whereby an integrated structure is formed by said cover, said base and said adjustable means due to said conjugated configuration of said adjustable means to resist at least one of deformation and twist subject to external force for many times of adjustment.

2. A connector according to claim 1, wherein said plug is inserted between said base and said cover along a direction that is substantially parallel with said upper surface and said lower surface.

3. A connector according to claim 2, wherein said rigid upper adjustable part is movable relative to said rigid lower adjustable part whereby the distance between said cover and said base is adjustable.

4. A connector according to claim 3, wherein:

said rigid upper adjustable part comprises an upper adjustable part side surface which is perpendicular to said lower surface of said cover;

said rigid lower adjustable part comprises a lower adjustable part side surface which is perpendicular to said upper surface of said base, and said lower adjustable part side surface faces said upper adjustable part side surface; and said rigid lower adjustable part side surface and said rigid upper adjustable part side surface are set in a conjugated configuration that enables said cover with said rigid upper adjustable part and said base with said rigid lower adjustable part to form an integrated structure to resist at least one of deformation and twist subjected to external forces.

5. A connector according to claim 1, wherein said circuit board comprises a PCMCIA card.

6. A connector according to claim 1, wherein said signal line is a network line.

7. A connector according to claim 1, wherein said signal line is a telephone line.

8. A connector according to claim 1, wherein said plug comprises a RJ series plug with a bias clip.

9. A connector according to claim 8, wherein said cover further comprises:

at least one clip passing recess formed on said lower surface of said cover, said clip passing recess being shaped so that said bias clip of said RJ series plug is able to pass through and said RJ series plug is able to be inserted into said connector.

10. A connector according to claim 9, wherein said cover further comprises:

at least one clip retention recess formed on said lower surface of said cover, said clip retention recess being shaped to receive said bias clip of said RJ series plug, thus to hold said RJ series plug in said connector.

11. A connector according to claim 10, wherein said clip retention recess is substantially T-shaped.

12. A connector for connecting a PCMCIA card and at least one signal line with an RJ series plug, each said RJ plug has a plurality of electric contacts, said connector comprising:

a base comprising an upper surface and a plurality of base electric contacts;

a cover comprising a lower surface that faces said upper surface; and at least one adjustable means connected to said base and said cover that is able to change the distance of said base and said cover and includes a conjugated configuration, said adjustable means further comprising a lower adjustable part, which comprises a lower adjustable part side surface being perpendicular to said upper surface of said base and having a preparation position groove and an operation position groove while said operation position groove is closer to said cover than said preparation position groove, and an upper adjustable part, which comprises an upper adjustable part side surface being perpendicular to said lower surface of said cover and having a projection portion perpendicular to said upper adjustable part side surface while said projection portion is engaged with one of said preparation position groove and said operation position groove, wherein said cover is able to move from a preparation position that the distance between said cover and said base is small, to an operation position that said distance between said cover and said base is large, and when said cover is at said operation position, said RJ series plug is inserted along a direction that parallels to both said upper surface and said lower surface, and then said RJ series plug is held between said base and said cover, and each of said plurality of electric contacts of said RJ series plug is in electric contact with the corresponding base electric contact to transmit signals between said signal line and said PCMCIA card through said RJ series plug, and said preparation position groove, said operation groove and said projection portion have a large contact surface, whereby an integrated structure is formed by said cover, said base, and said adjustable means due to said conjugated configuration of said adjustable means to resist at least one of deformation and twist subjected to external forces for many times of adjustment.

13. A connector according to claim 12, wherein said signal line comprises a network line.

14. A connector according to claim 12, wherein said signal line comprises a telephone line.

15. A connector according to claim 12, wherein said cover further comprises:

at least one clip passing recess formed on said lower surface of said cover, said clip passing recess being shaped so that said bias clip of said RJ series plug is able to pass through and said RJ series plug is able to be inserted into said connector.

16. A connector according to claim 12, wherein said cover further comprises:

at least one clip retention recess formed on said lower surface of said cover, said clip retention recess being shaped to receive said bias clip of said RJ series plug, thus to hold said RJ series plug in said connector.

17. A connector according to claim 16, wherein said clip retention recess is substantially T-shaped.

* * * * *